US007559548B2

(12) United States Patent
Dobrindt

(10) Patent No.: US 7,559,548 B2
(45) Date of Patent: Jul. 14, 2009

(54) APPARATUS FOR THE ALIGNMENT OF A STACK OF SHEETS

(75) Inventor: Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 408 days.

(21) Appl. No.: 10/586,270

(22) PCT Filed: Jan. 10, 2005

(86) PCT No.: PCT/EP2005/000136

§ 371 (c)(1),
(2), (4) Date: Jul. 17, 2006

(87) PCT Pub. No.: WO2005/068332

PCT Pub. Date: Jul. 28, 2005

(65) Prior Publication Data

US 2008/0265495 A1 Oct. 30, 2008

(30) Foreign Application Priority Data

Jan. 17, 2004 (DE) ..... 10 2004 002 646

(51) Int. Cl.
*B65H 1/00* (2006.01)

(52) U.S. Cl. ..... 271/171

(58) Field of Classification Search ..... 271/171, 271/223, 145, 226, 238, 240, 207; 399/393; 400/633, 633.1, 633.2; 270/58.12, 58.16, 270/58.17, 58.27; 74/31
See application file for complete search history.

(56) References Cited

U.S. PATENT DOCUMENTS 4,907,792 A * 3/1990 Washiashi et al. ..... 271/240
5,327,206 A * 7/1994 Ueda et al. ..... 399/402

(Continued)

FOREIGN PATENT DOCUMENTS

JP 6-115716 4/1994

(Continued)

*Primary Examiner*—Patrick H Mackey
*Assistant Examiner*—Jeremy Severson

(57) ABSTRACT

An apparatus for the alignment of a stack of sheets including at least one pair of trimming elements which can be adjusted at distances relative to each other in a substantially continuous manner in order to accommodate and align the stack between said trimming elements.

The trimming elements are coupled to allow their counter-directional movement with respect to each other, such that an automatic stop means preventing an enlargement of the distance between the trimming elements can be deactivated if required.

4 Claims, 5 Drawing Sheets

U.S. PATENT DOCUMENTS

| | | | | |
|---|---|---|---|---|
| 5,332,209 | A * | 7/1994 | Romansky et al. | 271/171 |
| 5,360,207 | A * | 11/1994 | Rauen et al. | 271/265.02 |
| 5,510,909 | A * | 4/1996 | Morikawa et al. | 358/498 |
| 5,611,528 | A | 3/1997 | Nakamura et al. | |
| 5,746,571 | A * | 5/1998 | Dietschi et al. | 414/795.7 |
| 5,769,409 | A * | 6/1998 | Nakamatsu et al. | 271/171 |
| 6,254,086 | B1 | 7/2001 | Sunou et al. | |
| 6,523,823 | B1 * | 2/2003 | Bakoledis | 271/223 |
| 6,830,245 | B2 * | 12/2004 | Matsushima et al. | 271/171 |
| 6,871,848 | B2 * | 3/2005 | Matsushima et al. | 271/171 |
| 7,398,969 | B2 * | 7/2008 | Elenes et al. | 271/9.05 |
| 2002/0080426 | A1 * | 6/2002 | Ito | 358/498 |
| 2005/0062218 | A1 * | 3/2005 | Murakami et al. | 271/171 |
| 2006/0113725 | A1 * | 6/2006 | Ito | 271/171 |
| 2007/0189822 | A1 * | 8/2007 | Nakamura | 399/393 |
| 2008/0251996 | A1 * | 10/2008 | Ubayashi | 271/226 |

FOREIGN PATENT DOCUMENTS

| | | |
|---|---|---|
| JP | 08-217262 | 8/1996 |
| JP | 08-310691 | 11/1996 |
| JP | 11-263451 | 9/1999 |
| JP | 2002-2968 | 1/2002 |

* cited by examiner

APPARATUS FOR THE ALIGNMENT OF A STACK OF SHEETS

FIELD OF THE INVENTION

The present invention relates to an apparatus for the alignment of a stack of sheets, in particular for the feeder of a printing machine, said apparatus comprising at least one pair of trimming elements which can be adjusted at distances relative to each other in a preferably continuous manner in order to accommodate and align the stack between said trimming elements.

BACKGROUND OF THE INVENTION

Japanese Patent Abstract JP-08310691 A, for example, has disclosed a guide for sheets of documents, which guide can be adjusted continuously as regards width of distance and which, in principle, could also be used for the alignment of a stack of sheets.

SUMMARY OF THE INVENTION

The present invention discloses an apparatus of the aforementioned type which permits the centered stack alignment in an inexpensive, reproducible and reliable manner, said alignment preferably occurring in transverse, as well as in longitudinal, direction even when sheets are to be duplex-printed.

In accordance with the present invention, this problem has been solved in that the trimming elements are coupled to allow their counter-directional movement with respect to each other, in that an automatic stop means preventing an enlargement of the distances between the trimming elements is provided, and in that this stop means can be deactivated if required.

Relative counter-directional movements as disclosed by prior art have ensured the centering of the stack so that the sheets are also aligned, optimally, and remain aligned, for printing the back side of the sheets after they have been flipped. Inasmuch as there is a coupling of movements, only one of the trimming elements needs to be moved manually, for example, while the other trimming element automatically follows this movement in a symmetrically counter-directional manner. As soon as an alignment of the stack has been achieved by adjusting a minimum distance between the trimming elements as a result of their abutment against the stack, the stop means prevents a return movement, along with the enlargement of the distance and the clearance of the stack. However, should a renewed or repeated alignment become necessary, this stop means can be deactivated, the distance between the trimming elements can again be enlarged, and a renewed alignment can be performed by reducing the distance in order to achieve a smoother stack abutting edge, for example, or to prevent or eliminate tilting of the stack, i.e., leaning or a so-called "skewing," in vertical and/or horizontal direction.

In accordance with one development of the present invention, this can be made possible in such a manner that the stop means comprises, only for reducing the distance between the trimming elements, a free-running free-wheel for an axle of a rotating non-driven positive-locking element which can be moved but of its positive-locked state in order to deactivate the stop means. In so doing, the positive-locking element may preferably be a gear rolling on a rack.

Preferably, the positive-locking element can be lifted out of its positive-locking state against a spring force.

Another preferred modification of the present invention provides that the trimming elements extend in a fence-like manner in upward direction. In this manner, even taller stacks are held securely and, at the same time, are accessible for lifting off sheets.

Preferably, several pairs of trimming elements are provided, in which case several pairs may even be coupled with each other for joint movement. Specifically, these trimming elements also allow an alignment of the stack to prevent or eliminate "skewing."

Preferably, at least two pairs of trimming elements can be adjusted in orthogonal directions relative to each other. Then the stack can be aligned in longitudinal direction and in transverse direction.

One embodiment, which may result in additional inventive features, without, however, restricting the scope of the invention to these, is illustrated by drawings. They show:

DETAILED DESCRIPTION OF THE PREFERRED EMBODIMENTS

Figure 1:
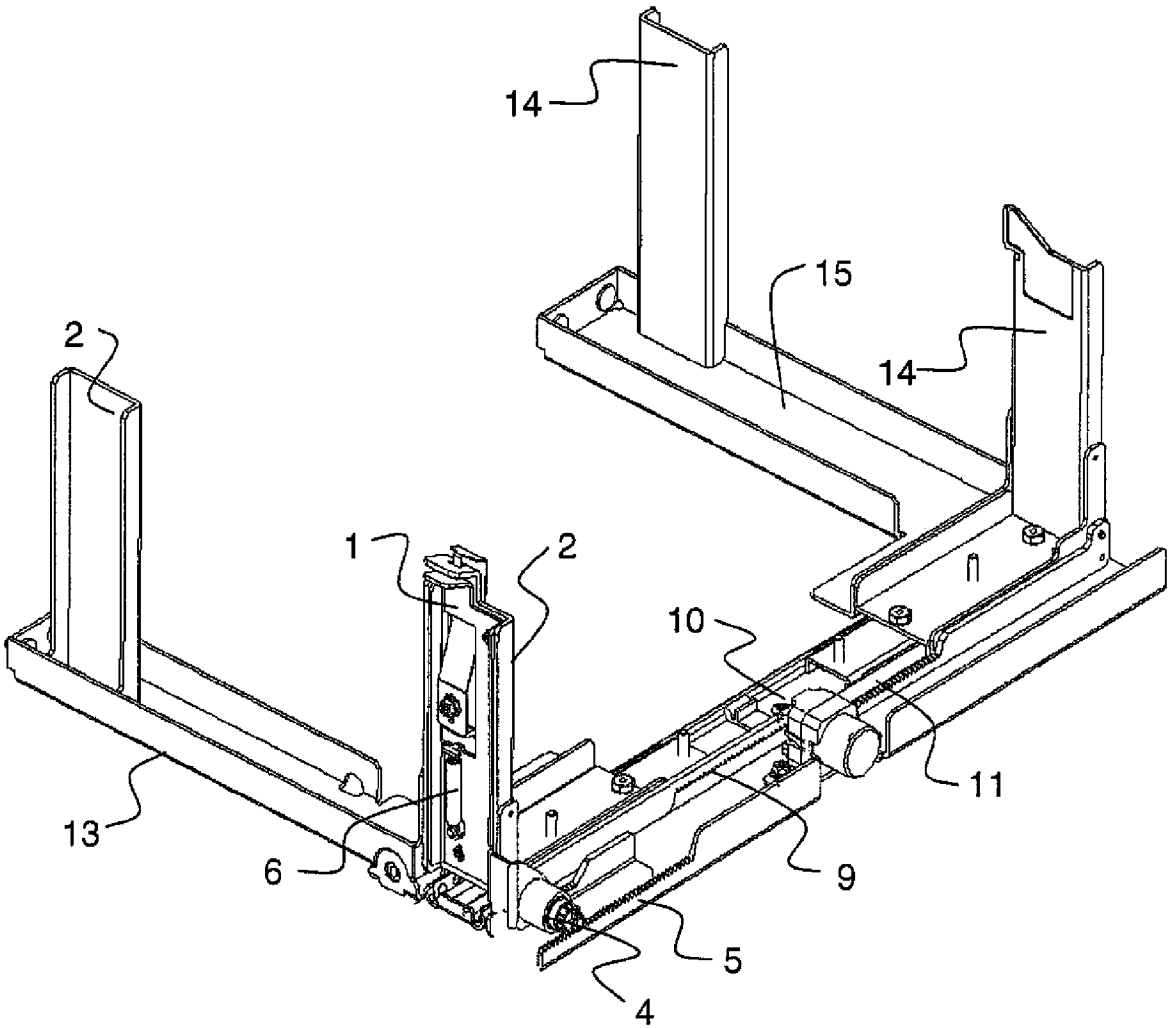
FIG. 1 a perspective view of one part of an inventive alignment apparatus for a stack of sheets.

FIG. 1 is a perspective view of a part of an apparatus for the alignment of a stack of sheets, as disclosed by the present invention.

The apparatus comprises fence-like upwardly extending trimming elements for the accommodation and alignment of a stack of sheets, which is arranged between them and not shown in detail, in which case two trimming elements 2 are located on a side close to the operator and two trimming elements 14 are located on the side away from the operator. For centered alignment, the operator slides trimming elements 2, which are connected with each other by means of a lateral member 13, away from himself/herself, until said trimming elements abut against the stack. With the aid of gear 10 (FIG. 2)—which runs on a rack 11 which, in turn, is connected with a lateral member 15 which supports trimming elements 14—this movement is transmitted symmetrically to trimming elements 14, which also abut against the stack, so that the stack is aligned and centered—as if by pincers—between trimming elements 2 and trimming elements 14. In so doing, gear 10, in turn, is driven by a rack 9 which is connected with lateral member 13.

Figure 3:
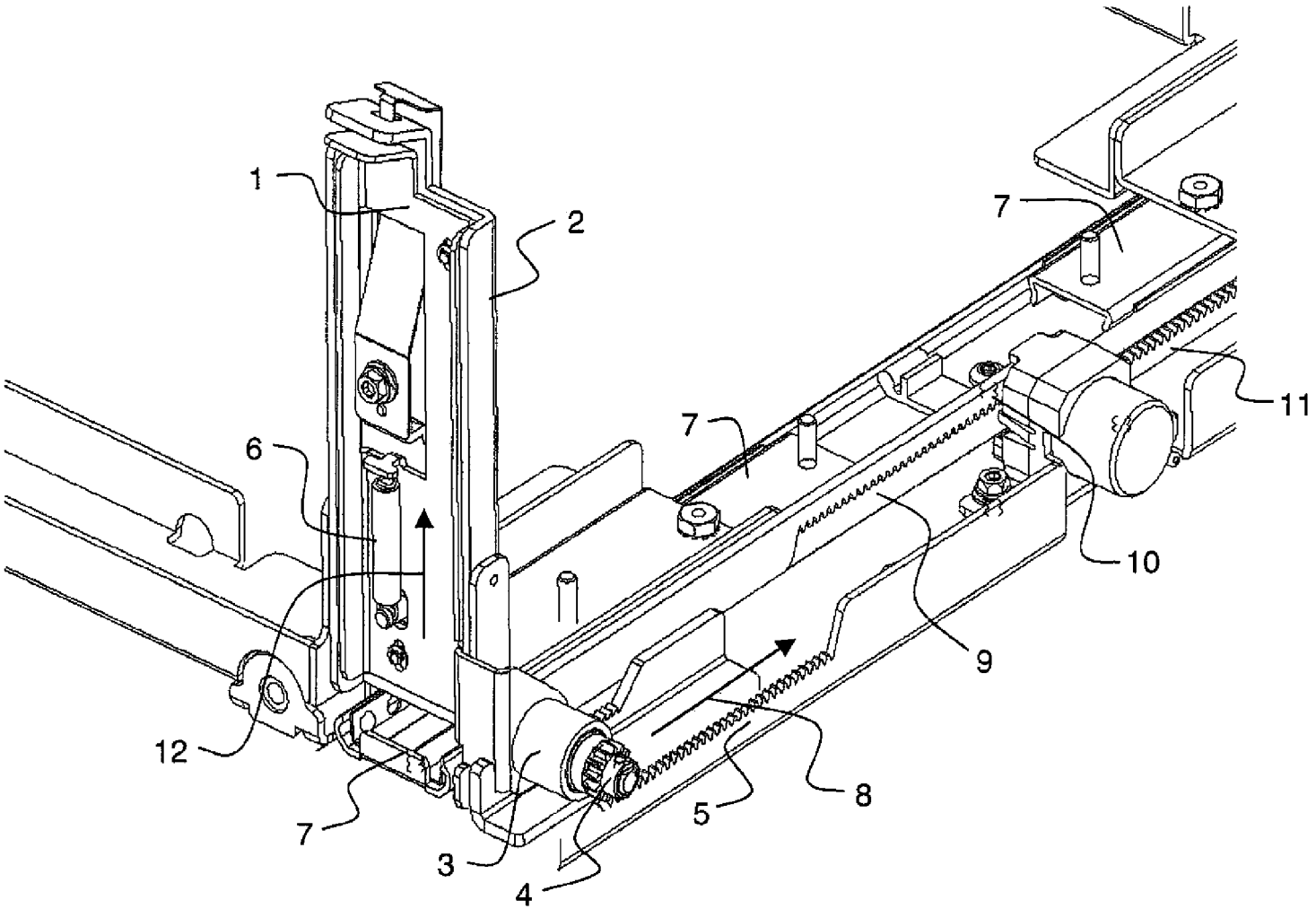
FIG. 3 an emphasized detail of a section of FIG. 1.

During this closing motion, which reduces the distance between trimming elements 2 and trimming elements 14, gear 4 also follows on a rack 5 in such a manner that said gear moves freely in this direction of rotation due to a free-wheel arrangement in sleeve 3 (FIG. 3). Gear 4 is stopped from moving freely in opposite direction, so that the trimming means can no longer be readily opened away from the stack. This stop means, however, can be deactivated in that a release flange 1 is pulled in upward direction against the force of a spring 6, said flange being connected with sleeve 3 so that gear 4 will move out of its engagement with rack 5.

Figure 2:
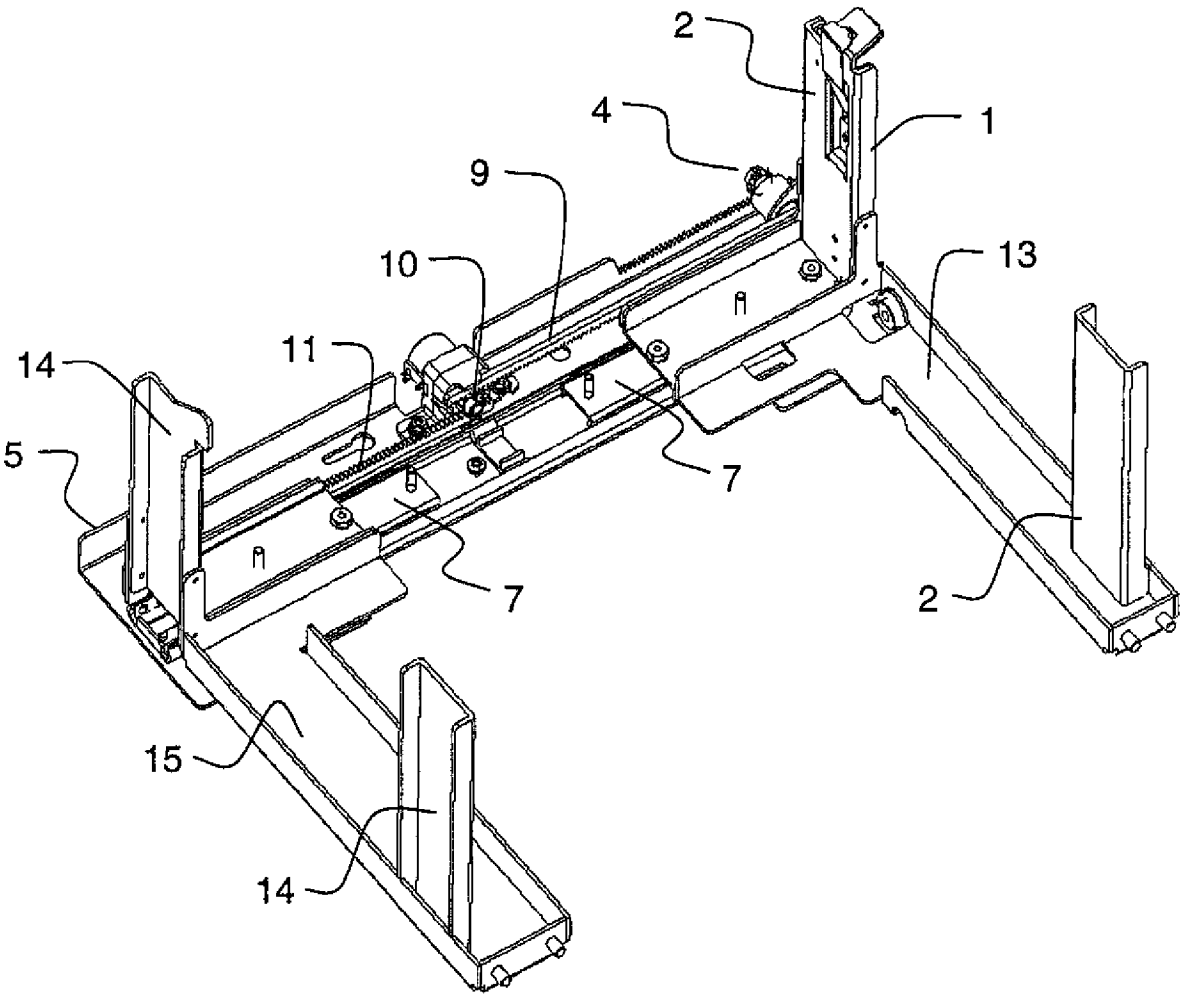
FIG. 2 the part of the apparatus of FIG. 1, from a different viewing angle.

FIG. 2 shows the part of the apparatus as in FIG. 1, from a different viewing angle. In FIG. 2, as well as in the remaining figures, the same components have the same reference numbers as in FIG. 1.

FIG. 2, again, shows specifically the arrangement of gears 4 and 10, but from a different perspective. Linear guides 7, designed to guide the relative movements of lateral members 13, 15 and of trimming elements 2 and 14 with respect to each other, are particularly emphasized in FIG. 2.

FIG. 3 provides a better view of a few details. FIG. 3 uses arrows to indicate the direction of motion 8 of the closing motion of the apparatus and the direction of motion 12 for releasing the engagement of gear 4.

Figure 4:
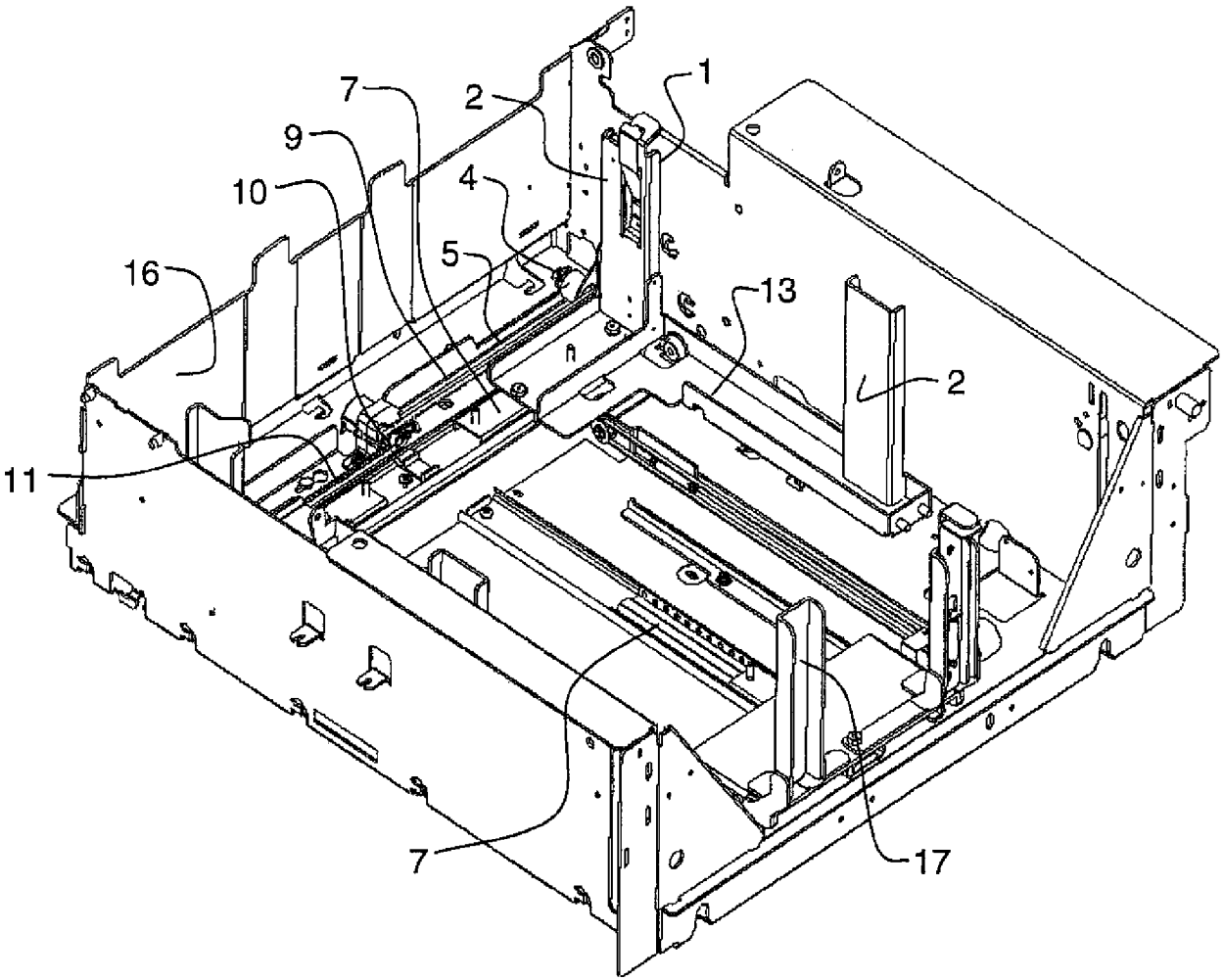
FIG. 4 a complete apparatus as in FIG. 2.

FIG. 4 shows the complete apparatus with a base frame 16.

Figure 5:
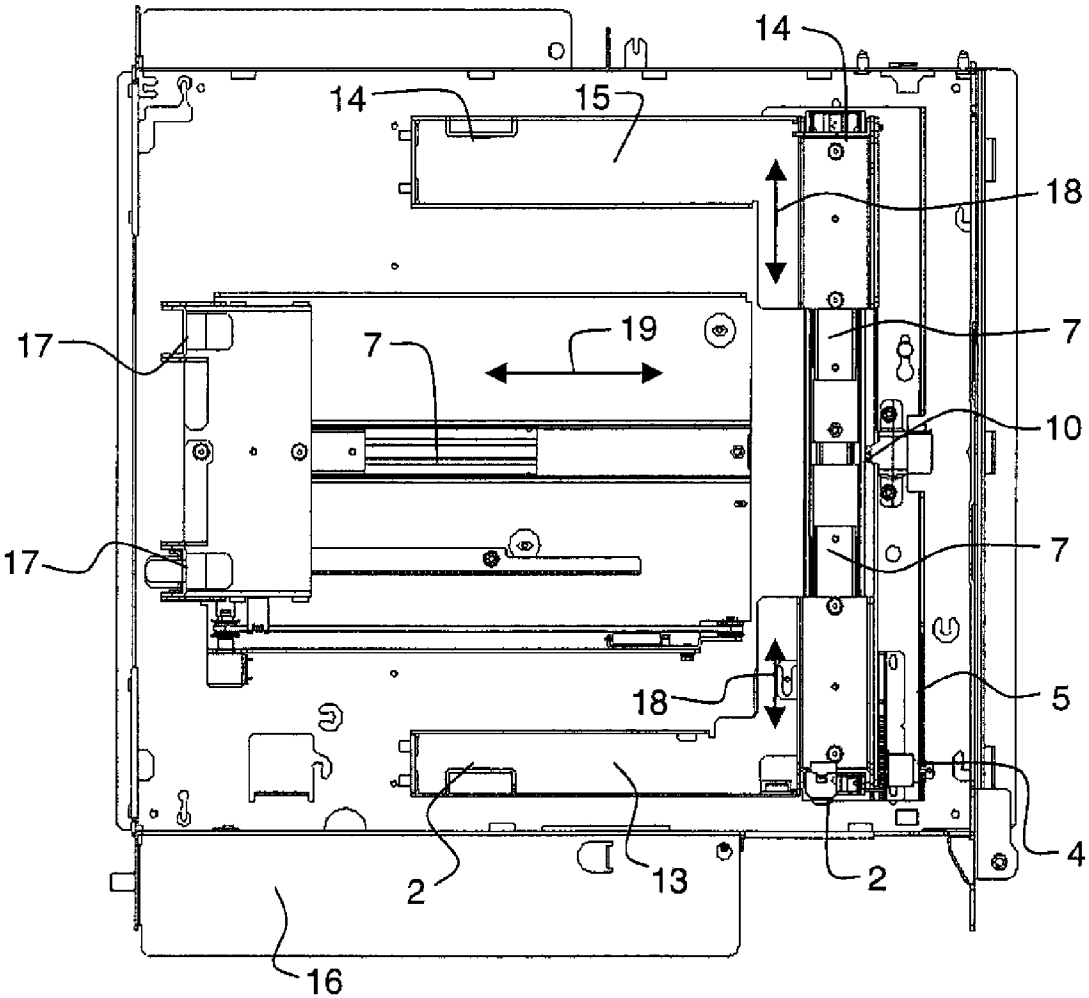
FIG. 5 a plan view of the device as in FIG. 4.

Furthermore, FIG. 4 shows additional trimming elements 17 for trimming the stack in longitudinal direction, while trimming elements 2 and 14 perform the transverse trimming. Trimming elements 17 could push the stack against the base frame which could act as an abutment; however, pairs of trimming elements could also be provided opposite each other and act as the corresponding symmetrical pincers, as described in conjunction with trimming elements 2 and 14. In the plan view of FIG. 5, the respective directions have again been indicated by arrows 18 and 19.

The invention claimed is:

1. Apparatus for the alignment of a stack of sheets for the feeder of a printing machine, said apparatus comprising:

at least one pair of trimming elements which can be adjusted at distances relative to each other in a substantially continuous manner in order to accommodate and align the stack of sheets between said trimming elements, said trimming elements coupled with each other for counter-directional motion, an automatic stop means for preventing an enlargement of the distance between the trimming elements, said stop means including a free-running free-wheel for an axle of a rotating non-driven positive-locking element, said positive-locking element including a gear rolling on a rack capable of being lifted out of its positive-locked state against a spring force in order to deactivate the stop means so that said stop means can be deactivated if required.

2. Apparatus as in claim 1, wherein the trimming elements extend in a fence-like manner in upward direction.

3. Apparatus as in claim 2, wherein several pairs of trimming elements are provided.

4. Apparatus as in claim 3, wherein at least two pairs of said several pairs of trimming elements can be adjusted in orthogonal directions relative to each other.

* * * * *